US010071592B2

(12) United States Patent
Brinkerhoff, III

(10) Patent No.: US 10,071,592 B2
(45) Date of Patent: Sep. 11, 2018

(54) DRAWING APPARATUS AND METHOD OF USE

(71) Applicant: Spencer L Brinkerhoff, III, Mesa, AZ (US)

(72) Inventor: Spencer L Brinkerhoff, III, Mesa, AZ (US)

( * ) Notice: Subject to any disclaimer, the term of this patent is extended or adjusted under 35 U.S.C. 154(b) by 37 days.

(21) Appl. No.: 15/050,841

(22) Filed: Feb. 23, 2016

(65) Prior Publication Data

US 2016/0243881 A1 Aug. 25, 2016

Related U.S. Application Data

(60) Provisional application No. 62/119,954, filed on Feb. 24, 2015.

(51) Int. Cl.
*B43L 13/20* (2006.01)

(52) U.S. Cl.
CPC ..... *B43L 13/201* (2013.01)

(58) Field of Classification Search
CPC ..... B43L 13/20; B43L 13/201; B43L 13/203; B43L 13/205; B43L 13/206; B43L 13/208; G09B 11/04
USPC ..... 33/563, 564, 565, 566
See application file for complete search history.

(56) References Cited

U.S. PATENT DOCUMENTS 147,942 A * 2/1874 Hutchinson ..... B43L 13/208 33/564
282,659 A * 8/1883 Newman ..... B43L 13/203 434/87
1,280,094 A * 9/1918 Smith ..... G09B 11/04 283/117
1,358,572 A * 11/1920 Poole ..... B43L 13/203 101/127
1,369,470 A * 2/1921 Sverre ..... B43L 13/208 101/127
1,668,396 A * 5/1928 Carroll ..... B05C 17/06 33/564
1,974,442 A * 9/1934 Baldwin ..... B43L 13/203 33/565
2,201,479 A * 5/1940 Davidson ..... B43L 13/203 434/87
2,797,493 A * 7/1957 Watson ..... B43L 13/201 33/565
3,822,879 A * 7/1974 Guitar ..... A63J 21/00 472/72
4,242,802 A * 1/1981 Jenner et al. ..... B43L 13/203 33/565
4,391,045 A * 7/1983 Fisher ..... B43L 11/08 33/27.11
4,563,154 A * 1/1986 Vandervort et al. ..... B43L 13/203 33/565
4,828,497 A * 5/1989 Kurgan ..... A47G 23/0303 273/157 R (Continued)

FOREIGN PATENT DOCUMENTS

DE 546200 C * 3/1932 ..... B43L 13/208
FR 1112809 A * 3/1956 ..... B43L 13/208
GB 2059357 A * 4/1981 ..... B43L 13/208

*Primary Examiner* — R. A. Smith

(57) ABSTRACT

A drawing aid configured to assist a user in creating illustrations such as, for example, cartoons, characters, caricatures, and figures is disclosed. The drawing aid includes a template that includes indicia configured to assist the user in creating illustrations with predetermined proportions.

17 Claims, 2 Drawing Sheets

(56) References Cited

U.S. PATENT DOCUMENTS

| | | | | | |
|---|---|---|---|---|---|
| 4,838,792 | A * | 6/1989 | Hoyeck | B43L 13/208 | 40/451 |
| 5,333,389 | A * | 8/1994 | Carroll | B43L 13/208 | 33/27.04 |
| 6,055,738 | A * | 5/2000 | Bardeen et al. | B43L 13/203 | 206/575 |
| 6,112,425 | A * | 9/2000 | Nelson et al. | B43L 13/205 | 33/563 |
| 6,971,880 | B1 * | 12/2005 | Setteducati | A63H 33/00 | 273/153 S |

* cited by examiner

DRAWING APPARATUS AND METHOD OF USE

CROSS REFERENCE TO RELATED APPLICATIONS

This application claims priority to and the benefit of U.S. Provisional Patent Application No. 62/119,954, filed 24 Feb. 2015, the disclosure of which is now expressly incorporated herein by reference.

FIELD OF THE DISCLOSURE

The present disclosure relates generally to a drawing aid, and more specifically to a drawing aid for assisting a user in creating illustrations.

BACKGROUND

Drawing aids may be used to assist a user in creating illustrations, for example, through drawn or painted images. To give a few examples, some drawing aids may help the user create a desired curve or line, display images onto a base for tracing, or provide calibrated markings to measure distances.

Some drawing aids provide assistance with specific processes during the creation of illustrations. As an example, some drawing aids provide a straight edge while others may provide different curved edges. As such, a number of drawing aids may be needed to create the finished illustration. As a result, it may be time consuming to use the drawing aids. Other drawing aids may be complex or difficult to use which results in inconsistent illustrations or illustrations with poor quality.

Accordingly, there remains a need for further contributions in this area of technology, including contributions that improve consistency, speed, and accuracy of applications.

SUMMARY

The present disclosure may comprise one or more of the following features recited in the attached claims and combinations thereof, and/or one or more of the following features and combination thereof.

In one aspect of the disclosure, an illustrative drawing aid is disclosed. Other embodiments include apparatuses, systems, devices, hardware, methods, and combinations for assisting a user create illustrations. Further embodiments, forms, features, aspects, benefits, and advantages of the present application shall become apparent from the description and figures provided herewith.

Various illustrative embodiments of a drawing aid are provided. A drawing aid may include a template configured to provide means for assisting a user to create an illustration with predetermined proportions by providing calibrated markings indicative of a position of guide marks that locate features of the illustration.

In some embodiments, the template may include a top face and a bottom face spaced apart from and opposite the top face. The top and bottom faces may be circular.

In some embodiments, the top face may include the calibrated markings. The bottom face may include indicia that indicate the illustration for which the template is configured to assist the user to create.

In some embodiments, the template may comprise a rigid material. Illustratively, the calibrated markings may include a first line that extends across the top face and intersects a center point of the top face.

In some embodiments, the calibrated markings may include a second line and a third line. The second line may be spaced apart from and about parallel with the first line. The third line may be spaced apart from and about parallel with the second line to locate the first line between the second line and the third line. Illustratively, the first, second, and third lines may be spaced apart about equidistant from one another.

In some embodiments, the calibrated markings may include a fourth line. The fourth line may extend across the top face between the second line and a perimeter of the template. The fourth line may be about perpendicular with the second line.

In some embodiments, the calibrated markings may include a fifth line that extends across the top face between the second line and the perimeter. The fifth line may be spaced apart from the fourth line. In some embodiments, the fifth line may be about parallel with the fourth line.

In some embodiments, the drawing aid may further comprise an instruction sheet. The instruction sheet may include indicia that depict a number of steps for the user to follow to create the illustration.

According to another aspect of the disclosure, a method of using a drawing aid to create an illustration may be disclosed. The method may include moving a template to a first position on a base material, the template including calibrated markings indicative of a position of guide marks that locate features of the illustration to be created, tracing along a portion of the template to form a first line on the base material, and marking a first guide mark adjacent to one of the calibrated markings included in the template without moving the template from the first position.

In some embodiments, the method may further include drawing a feature of the illustration with predetermined proportions based on a location of the first guide mark. In some embodiments, the template may be circular and the first line may be curved.

In some embodiments, the method may further include moving the template to a second position relative to the first position and marking a second guide mark adjacent to the calibrated markings included in the template. In some embodiments, the method may further include drawing a head of the illustration with predetermined proportions based on a location of the first guide mark and drawing a body of the illustration with predetermined proportions based on a location of the second guide mark.

According to another aspect of the disclosure, a drawing kit may include a template and an instruction sheet. The template may include a top face and a bottom face spaced apart from and opposite the top face. The top face may include first indicia for assisting a user create an illustration having predetermined proportions. The bottom face may include second indicia for identifying the illustration for which the template assists the user to create. The instruction sheet may include third indicia which illustrates a number of steps for assisting the user create the illustration.

In some embodiments, the first indicia included in the top face may include calibrated markings that include a first set of parallel lines and a second set of lines that are perpendicular to the first set of lines. In some embodiments, the template may be circular and may be relatively thin.

In some embodiments, the template may include a sidewall that extends between the top face and the bottom face of the template. The sidewall may be relatively smooth and continuous.

These and other features of the present disclosure will become more apparent from the following description of the illustrative embodiments.

Figure 1:
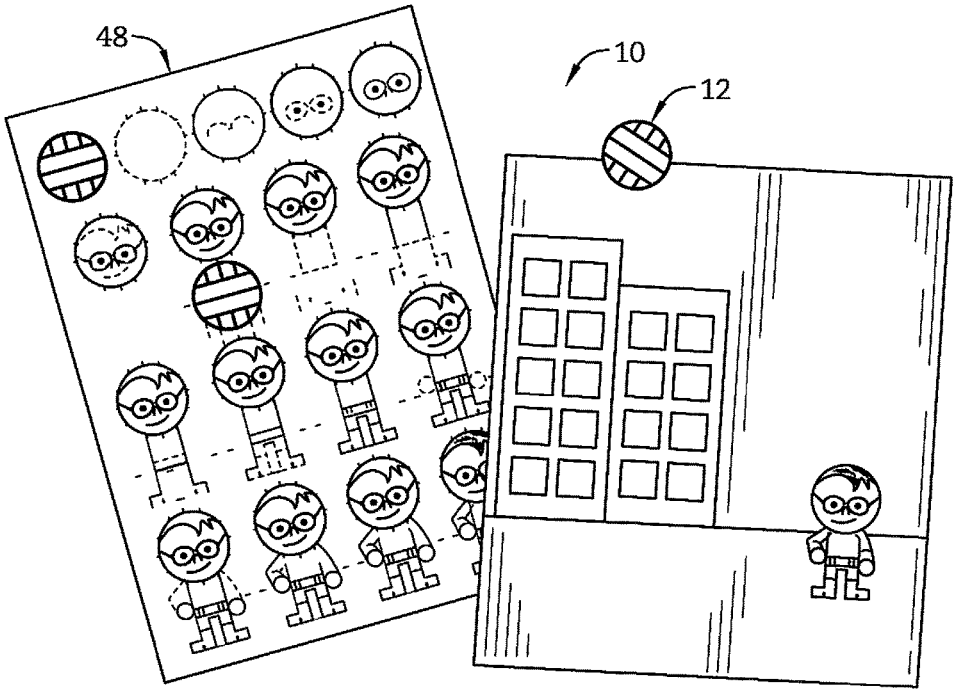
FIG. 1 is an elevation view of a drawing aid including a template (sometimes called a drawing coin) and an instruction sheet employing features of the present disclosure and further showing a drawing that was produced using the template and instruction sheet.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE DRAWINGS

For the purposes of promoting an understanding of the principles of the invention, reference will now be made to a number of illustrative embodiments shown in the attached drawings and specific language will be used to describe the same. While the concepts of this disclosure are described in relation to drawing aid for use with a pencil and paper, it will be understood that they are equally applicable to other media generally, and more specifically to materials manually applied to a base such as, for example, ink, colored pencil, marker, pencil, chalk, paint, charcoal, crayon, graphite, and fabric pens and a variety of bases such as, for example, paper, canvas, fabric, glass, plastic, the human body, metal, wood, plaster, and walls. Further, the concepts of this disclosure are similarly applicable for use with any media, in applications where it is desirable to improve consistency, speed, and accuracy of applications.

FIG. 1 depicts a drawing aid 10 (sometimes called a drawing kit) arranged to assist a user in creating illustrations such as, for example, cartoons, caricatures, and figures. In the illustrative embodiment, the drawing aid 10 includes a template 12 and an instruction sheet 48 as shown in FIG. 1. The template 12 and instruction sheet 48 may be used in tandem to assist a user in creating a cartoon character, for example. In other embodiments, the user may modify the illustrations using their imagination. In yet other embodiments, the user may use the drawing aid 10 to help create their own figures or characters from their imagination. In the illustrative embodiment, the drawing aid 10 is configured to be used with pencils and paper. In other embodiments, the drawing aid 10 may be used with a plurality of media.

Figure 2:
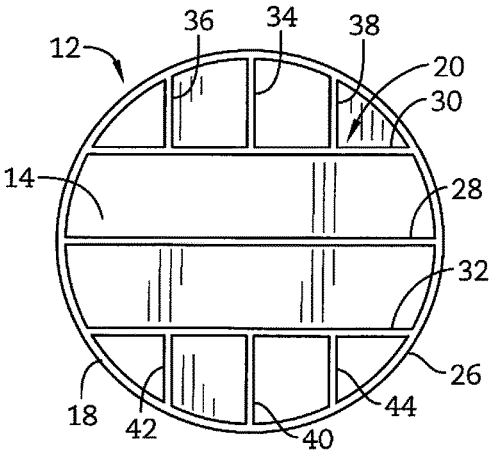
FIG. 2 is a top view of the template included in the drawing aid of FIG. 1 showing that a top face of the template is configured to provide indicia to assist a user in creating character features with predetermined proportions.
Figure 3:
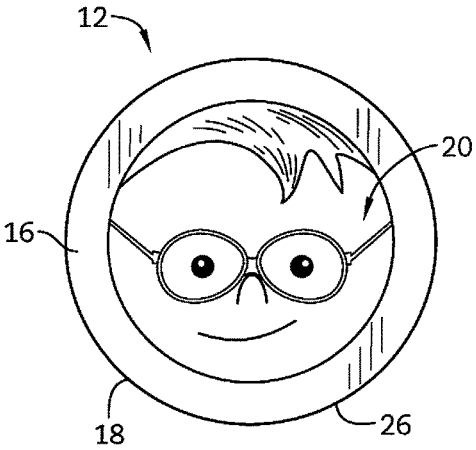
FIG. 3 is a bottom view of the template of FIG. 1 showing that a bottom face of the template includes indicia to identify which exemplary character(s) the template is configured to assist the user in creating.

The drawing aid 10 illustratively comprises the template 12 sometimes called a coin, drawing coin, trinket, or token as shown in FIGS. 1-3. The template 12 is a marked template 12 that includes indicia 20 configured to assist a user in creating drawings with desired and/or predetermined proportions. The illustrative marked template 12 is relatively small so as to fit in a pocket, art box, or pencil bag, for example. The template 12 may have a motif or theme. As an example, the template 12 may have a known children's cartoon or movie theme. The template 12 may also be a souvenir. A number of differently themed templates 12 may be made available so as to cause them to be collectable or a collector's item.

Figure 4:
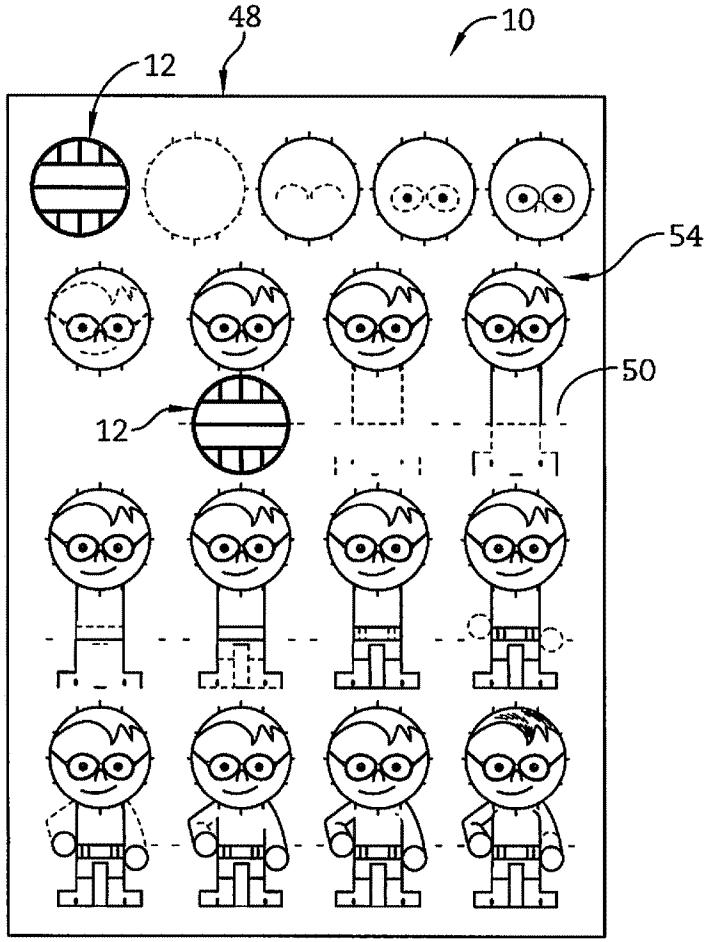
FIG. 4 is a top view of the instruction sheet included in the drawing aid of FIG. 1 showing that a front side of the instruction sheet includes indicia that instructs a user in creating a cartoon character.

The marked template 12 is arranged to allow a user to trace around a portion of the marked template 12 as suggested in FIG. 4. The marked template 12 is formed to include contours that are proportional with and correspond with features of the desired cartoon character. The marked template 12 is rigid so that the user may press a drawing utensil against the contour of the marked template 12 and against a sheet of paper without deforming the marked template 12 to create a curve or line corresponding to a feature of the cartoon character or other drawings of their own imagination.

In the illustrative embodiment, the marked template 12 comprises plastic material. In some embodiments, the marked template 12 comprises rubber. In some embodiments, the marked template 12 comprises metallic material. In some embodiments, the marked template 12 comprises a fiber material such as, for example, paper.

Illustratively, the marked template 12 is circular when viewed from above as shown in FIG. 2. In other embodiments, the marked template 12 is elliptical, eccentric, rectangular, square, or any other suitable shape. In some embodiments, the marked template 12 comprises a unique shape.

The marked template 12 includes a top face 14, a bottom face 16 spaced apart from the top face 14, and an outer sidewall 18 that extends between and interconnects the top face 14 and bottom face 16 along a perimeter 26 of the marked template 12 as shown in FIGS. 2 and 3. The top face 14 illustratively includes indicia 20 for assisting the user in drawing characters with desired proportions. The bottom face 16 illustratively includes indicia 22 for identifying or suggesting the characters or figures for which the marked template 12 may assist the user in drawing as shown in FIG. 3. The outer sidewall 18 is shaped to allow the user to trace along the outer sidewall 18 to create predetermined contours and shapes. In other embodiments, the indicia 22 on the bottom face 16 may be omitted. In the illustrative embodiment, the marked template 12 is relatively flat. In the illustrative embodiment, the marked template 12 is relatively thin compared to an area of the faces 14, 16 of the marked template.

In the illustrative embodiment, the outer sidewall 18 is substantially smooth and continuous as shown in FIGS. 2 and 3. In other embodiments, the outer sidewall 18 may comprise ridges. In other embodiments, a portion of the outer sidewall 18 is substantially smooth and other portions comprise ridges.

The indicia 20 comprise calibrated markings 20 (sometimes called a pattern) for assisting the user in drawing a character as shown in FIG. 2. Illustratively, the calibrated markings 20 indicate the location of one or more features of the character the user is drawing. For example, the calibrated markings 20 may indicate the location of a mouth of the character, the location of a point located on a limb of the character, a height of a point located on a feature relative to another feature, or any other location of a feature of the character.

The user may place the marked template 12 on the sheet of paper and create a mark on the sheet of paper adjacent to the calibrated markings 20 to identify the location of a portion of the feature. The user may use the marked location as a reference or guide to create the remaining portions of the feature or character. As a result, the marked template 12 assists the user in creating a character with features having a desired shape and proportion relative to other features of the character.

In the illustrative embodiment, the calibrated markings 20 include a plurality of lines. The lines extend across the top face 14 toward the perimeter 26 of the top face 14 as shown in FIG. 2. In the illustrative embodiment, the lines have ends that are spaced apart from the perimeter 26. Though the lines do not extend to the perimeter, the end of the lines are close to the perimeter 26 to allow the user to create a mark on the paper that is aligned with the lines and adjacent to the sidewall 18. In other embodiments, the lines have ends located on the perimeter 26.

Illustratively, a first line 28 extends across the top face 14 and intersects a center point of the top face 14 as shown in FIG. 2. A second line 30 is spaced apart from the first line 28. A third line 32 is spaced apart from the first line 28 and the second line 30 to locate the first line 28 therebetween. The second line 30 and the third line 32 are about parallel with the first line 28. In the illustrative embodiment, the first, second, and third lines 28, 30, 32 are spaced apart equidistant from one another.

A fourth line 34 extends across the top face 14 between the second line 30 and the perimeter 26 as shown in FIG. 2. The fourth line 34 is about perpendicular with the first line 28 and aligned with the center point of the top face 14.

A fifth line 36 extends across the top face 14 between the second line 30 and the perimeter 26. The fifth line 36 is spaced apart from the fourth line 34.

A sixth line 38 extends across the top face 14 between the second line 30 and the perimeter 26. The sixth line 38 is spaced apart from the fourth line 34 and the fifth line 36 to locate the fourth line 34 therebetween. The fifth line 36 and the sixth line 38 are about parallel with the fourth line 34. In the illustrative embodiment, the fourth, fifth, and sixth lines 34, 36, 38 are spaced apart equidistant from one another.

A seventh line 40 extends across the top face 14 between the third line 32 and the perimeter 26 opposite the fourth line 34 as shown in FIG. 2. The seventh line 40 is perpendicular with the first line 28 and aligned with the center point of the top face 14 and the fourth line 34.

An eighth line 42 extends across the top face 14 between the third line 32 and the perimeter 26. The eighth line 42 is spaced apart from the seventh line 40. Illustratively, the eighth line 42 is aligned with the fifth line 36.

A ninth line 44 extends across the top face 14 between the third line 32 and the perimeter 26. The ninth line 44 is spaced apart from the seventh line 40 and the eighth line 42 to locate the seventh line 40 therebetween. Illustratively, the ninth line 44 is aligned with the sixth line 38. The eighth line 42 and the ninth line 44 are about parallel with the seventh line 40. In the illustrative embodiment, the seventh, eighth, and ninth lines 40, 42, 44 are spaced apart equidistant from one another.

The indicia 22 on the bottom face 16 of the marked template 12 is configured to identify or suggest the characters or figures for which the marked template 12 may assist the user in drawing as shown in FIG. 3. In the illustrative embodiment, the indicia 22 comprises a face of the cartoon character associated with the marked template 12 and the instruction sheet 48. In other embodiments, the indicia 22 may include text such as, for example, the name of a character, image, figure, etc. or the business associated with the character, image, figure, etc. In some embodiments, the indicia 22 include text and an image such as a face, for example. In other embodiments, the indicia 22 are thematic.

The indicia 20, 22 may be inscribed into the faces 14, 16 respectively. In some embodiments, the indicia 20, 22 comprise an ink layer coupled with the faces 14, 16. In some embodiments, a material such as, for example, metal, plastic, or rubber is applied to the faces 14, 16 to form the indicia 20, 22. In some embodiments, the indicia 20, 22 are formed with the marked template 12 and extend outwardly away from the faces 14, 16.

In some embodiments, the marked template 12 includes an inner sidewall (not shown) that extends through the marked template 12 between the top face 14 and the bottom face 16 to form an aperture in the marked template 12. In some embodiments, the aperture is formed to be centered on the center point of the marked template 12. In some embodiments, the inner sidewall is circular when viewed from above. In embodiments having an inner sidewall, the lines of the calibrated markings 20 may extend between the perimeter 26 and the inner sidewall. The aperture may be used to indicate or form additional features of the character.

Figure 5:
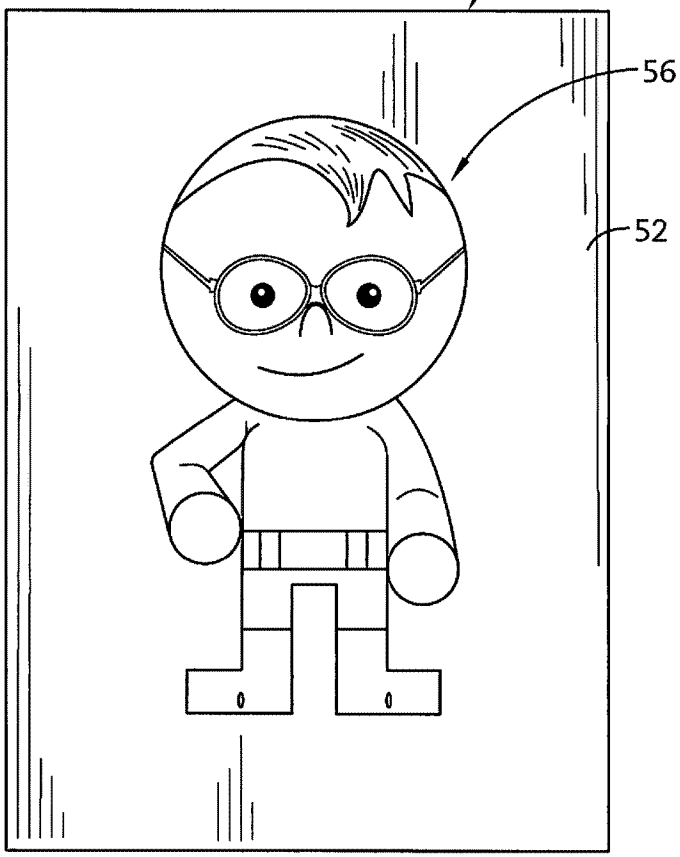
FIG. 5 is a bottom view of the instruction sheet of FIG. 4 showing that a back side of the instruction sheet includes indicia to identify which character(s) the instruction sheet is configured to assist the user in creating.

The instruction sheet 48 illustratively includes a front side 50 and a back side 52 opposite the front side 50. The front side 50 includes indicia 54 for assisting the user in drawing the character with desired proportions as shown in FIG. 4. The back side 52 illustratively includes indicia 56 for identifying or suggesting the character or figure for which the instruction sheet 48 may assist the user in drawing as shown in FIG. 5.

In other embodiments, the indicia 56 on the back side 52 may be omitted. In other embodiments, the instruction sheet 48 may include a plurality of bound or unbound sheets. In some embodiments, the indicia 54 on the front side 50 appear on a first sheet and the indicia 56 is on a second sheet instead of the back side 52 of the first sheet. In other embodiments, the indicia 54 are divided and each portion of the indicia 54 appears on a different sheet. In yet other embodiments, the front side 50 and back side 52 of the instruction sheet 48 may be formed on a body such as a cube, cylinder, or any other suitable shape having a number of sides.

The indicia 54 on the front side 50 of the instruction sheet 48 comprises a pattern 54 for assisting the user in drawing illustrations such as, for example, a character as shown in FIG. 4. Illustratively, the pattern 54 includes a number of steps the user may take to create the character. The pattern 54 indicates one or more markings the user may make on the paper in each step before continuing to the next step. The user is assisted in creating the character with predetermined proportions quickly and accurately by following each step. Each step may include a number of illustrations and a number of sub steps as shown in FIG. 4.

In the illustrative embodiment, a first step is shown in an upper left portion of the sheet of paper as shown in FIG. 4. The first step includes tracing around the marked template 12 to form a circle on the sheet of paper. In a second step, the user is instructed to maintain the marked template 12 in place and to make a number of small guide marks corresponding to the calibrated markings 20 around the circle. In a third step, the user moves the marked template 12 and is instructed to draw a number of lines to form features of the illustration. As shown in FIG. 4, the user is assisted in creating proportional features by the guide marks.

In a fifth step, the user is instructed to position the marked template 12 below the traced circle and make additional guide marks as shown in FIG. 4. In a sixth step, the user is instructed to use the additional guide marks to draw additional features of the character until the character is completed.

The indicia 56 on the back side 52 of the instruction sheet 48 is configured to identify or suggest the characters or figures for which the instruction sheet 48 may assist the user in drawing as shown in FIG. 5. The indicia 56 illustratively provide an image of the cartoon character associated with the marked template 12 and for which the instruction sheet 48 may assist the user in creating. In other embodiments, the indicia 56 may include text such as, for example, the name of a character, image, figure, etc. or the business associated with the character, image, figure, etc. In some embodiments, the indicia 56 include text and an image.

The indicia 54, 56 may be inscribed into the sides 50, 52 respectively. In some embodiments, the indicia 54, 56 comprise an ink layer coupled with the sides 50, 52. In some embodiments, a material such as, for example, metal, plastic, or rubber is applied to the sides 50, 52 to form the indicia 54, 56. In some embodiments, the indicia 54, 56 are formed with the instruction sheet 48 and extend outwardly away from the sides 50, 52.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A drawing aid comprising:

a template configured to provide means for assisting a user to create an illustration with predetermined proportions by providing calibrated markings indicative of a position of guide marks that locate features of the illustration, wherein the template includes a top face and a bottom face spaced apart from and opposite the top face and wherein the top and bottom faces are circular.

2. The drawing aid of claim 1, wherein the top face includes the calibrated markings and the bottom face includes indicia that indicate the illustration for which the template is configured to assist the user to create.

3. The drawing aid of claim 2, wherein the template comprises a rigid material.

4. The drawing aid of claim 1, wherein the calibrated markings include a first line that extends across the top face and intersects a center point of the top face.

5. The drawing aid of claim 4, wherein the calibrated markings include a second line spaced apart from and about parallel with the first line and a third line spaced apart from and about parallel with the second line to locate the first line between the second line and the third line.

6. The drawing aid of claim 5, wherein the first, second, and third lines are spaced apart about equidistant from one another.

7. The drawing aid of claim 5, wherein the calibrated markings include a fourth line that extends across the top face between the second line and a perimeter of the template and the fourth line is about perpendicular with the second line.

8. The drawing aid of claim 7, wherein the calibrated markings include a fifth line that extends across the top face between the second line and the perimeter and the fifth line is spaced apart from the fourth line.

9. The drawing aid claim 8, wherein the fifth line is about parallel with the fourth line.

10. The drawing aid of claim 1, further comprising an instruction sheet that includes indicia that depict a number of steps for the user to follow to create the illustration.

11. A method of using a drawing aid to create an illustration, the method comprising:

moving a template to a first position on a base material, the template including calibrated markings indicative of a position of guide marks that locate features of the illustration to be created, tracing along a portion of the template to form a first line on the base material;

marking a first guide mark adjacent to one of the calibrated markings included in the template without moving the template from the first position; and drawing a feature of the illustration with predetermined proportions based on a location of the first guide mark, wherein the template is circular and the first line is curved.

12. The method of claim 11, further comprising:

moving the template to a second position relative to the first position; and marking a second guide mark adjacent to the calibrated markings included in the template.

13. The method of claim 12, further comprising:

drawing a head of the illustration with predetermined proportions based on a location of the first guide mark; and drawing a body of the illustration with predetermined proportions based on a location of the second guide mark.

14. A drawing kit comprising:

a template including a top face and a bottom face spaced apart from and opposite the top face, the top face includes first indicia for assisting a user create an illustration having predetermined proportions, and the bottom face includes second indicia for identifying the illustration for which the template assists the user to create, and an instruction sheet including third indicia which illustrates a number of steps for assisting the user create the illustration.

15. The drawing kit of claim 14, wherein the first indicia included in the top face includes calibrated markings that include a first set of parallel lines and a second set of lines that are perpendicular to the first set of lines.

16. The drawing kit of claim 15, wherein the template is circular and relatively thin.

17. The drawing kit of claim 14, wherein the template further includes a sidewall that extends between the top face and the bottom face and the sidewall is relatively smooth and continuous.

* * * * *